US009514724B2

(12) United States Patent
Setoguchi et al.

(10) Patent No.: US 9,514,724 B2
(45) Date of Patent: Dec. 6, 2016

(54) SAMPLING DEVICE, ELECTRONIC INSTRUMENT, METHOD, AND PROGRAM

(71) Applicant: CASIO COMPUTER CO., LTD., Tokyo (JP)

(72) Inventors: Masaru Setoguchi, Tokyo (JP); Yukina Ishioka, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/665,233

(22) Filed: Mar. 23, 2015

(65) Prior Publication Data

US 2015/0310843 A1 Oct. 29, 2015

(30) Foreign Application Priority Data

Apr. 25, 2014 (JP) ..... 2014-092086

(51) Int. Cl.
*G10H 7/00* (2006.01)
*G10H 1/42* (2006.01)

(52) U.S. Cl.
CPC ..... *G10H 1/42* (2013.01); *G10H 2250/641* (2013.01)

(58) Field of Classification Search
CPC ..... G10H 2240/145; G10H 2250/641; G10H 2240/071; G10H 2210/071; G10H 2210/371; G10H 2210/341; G10H 2250/631; G10H 2210/301; G10K 15/04
See application file for complete search history.

(56) References Cited

U.S. PATENT DOCUMENTS 7,709,723 B2 * 5/2010 Pachet ..... G10H 1/0066 84/600
9,012,756 B1 * 4/2015 Goldman ..... G10H 1/0066 84/610
2002/0035915 A1 * 3/2002 Tolonen ..... G10G 3/04 84/616
2002/0170414 A1 * 11/2002 Ueshima ..... G10H 1/361 84/607
2003/0131715 A1 * 7/2003 Georges ..... G10H 1/0025 84/609
2004/0255764 A1 * 12/2004 Mori ..... G10H 3/146 84/742
2005/0098022 A1 * 5/2005 Shank ..... G10H 1/0025 84/612
2005/0145099 A1 * 7/2005 Lengeling ..... G10H 7/10 84/645
2005/0227674 A1 * 10/2005 Kopra ..... H04M 1/72522 455/414.1

(Continued)

FOREIGN PATENT DOCUMENTS

JP 2005-331878 A 12/2005

*Primary Examiner* — Marlon Fletcher
(74) *Attorney, Agent, or Firm* — Chen Yoshimura LLP

(57) ABSTRACT

The present invention receives sound wave data from a sound inputted into a microphone and samples the sound wave data received using a CPU to obtain sampled data as a digitized tone data, which is then stored in a sampling memory. The CPU performs auto-play of a sound using the digitized tone data sampled by the sampling and stored in the sampling memory. Thus, a result of the sampling is automatically provided to the user after the sampling takes place and the user can intuitively understand what can be done through sampling.

11 Claims, 8 Drawing Sheets

(56) References Cited

U.S. PATENT DOCUMENTS

| | | | | |
|---|---|---|---|---|
| 2006/0130637 | A1* | 6/2006 | Crebouw | G10L 19/0204 84/603 |
| 2007/0129114 | A1* | 6/2007 | Small | H04M 3/42178 455/567 |
| 2008/0289478 | A1* | 11/2008 | Vella | G10H 1/0008 84/602 |
| 2010/0192753 | A1* | 8/2010 | Gao | G10H 1/0091 84/610 |
| 2010/0300269 | A1* | 12/2010 | Applewhite | G10H 1/0058 84/610 |
| 2013/0053993 | A1* | 2/2013 | Setoguchi | G10H 1/42 700/94 |
| 2015/0040740 | A1* | 2/2015 | Setoguchi | G10H 1/18 84/603 |

* cited by examiner

| SS Number | Rhythm Instrument |
|---|---|
| 1 | Bass Drum |
| 2 | Snare Drum |
| 3 | Hi-Hat |
| 4 | Cymbal |
| 5 | Tam |

FIG. 11

After Initial Sampling (After SS1 Sampling)

| | | | | |
|---|---|---|---|---|
| SS1 | Boom | Boom | Boom | Boom |

FIG. 12A

After SS2 Sampling

| | | | | |
|---|---|---|---|---|
| SS2 | Tak | Tak | Tak | Tak |
| SS1 | Boom | Boom | Boom | Boom |

FIG. 12B

After SS3 Sampling

| | | | | | | | | |
|---|---|---|---|---|---|---|---|---|
| SS3 | Tik | Tik | Tik | Tik | Tik | Tik | Tik | Tik |
| SS2 | | Tak | | Tak | | Tak | | Tak |
| SS1 | Boom | | Boom | | Boom | | Boom | |

FIG. 12C

SAMPLING DEVICE, ELECTRONIC INSTRUMENT, METHOD, AND PROGRAM

This application claims the benefit of Japanese Patent Application No. 2014-092086, filed in Apr. 25, 2014, which is hereby incorporated by reference in its entirety.

BACKGROUND OF THE INVENTION

1. Technical Field

The present invention relates to a sampling device, an electronic instrument, a method, and a program.

2. Background Art

Conventionally, so-called sampling keyboards have existed. A sampling keyboard records people's voices and environmental sounds in a simple manner and can play the recorded sounds if a user depresses the keys of the keyboard. A sampling keyboard either has a built-in microphone or is connected to an external microphone to receive external sound wave data. The sampling keyboard performs A/D (analog-digital) conversion to the external sound wave data that is received and then stores the converted data in an internal memory. The recorded sound wave data are used as a tone of the keyboard and can be sounded or played by depressing the keys of the keyboard.

On one hand, there are expensive sampling keyboards for professionals; while on the other hand, there are inexpensive sampling keyboards that have sampling features for children. This type of inexpensive sampling keyboards is purchased for children that do not have expert knowledge and as gifts. Thus, there is a need to make these features easily accessible to users that do not have prior knowledge regarding sampling features.

The following is a known technology that provides more appropriate guidance regarding how to operate an electronic instrument (technology described in Japanese Patent Application Laid-Open Publication No. 2005-331878, for example). The electronic instrument using this conventional technology has a guide member that provides guidance regarding how to operate the electronic instrument, a first guide database that associates a plurality of operations with a first plurality of guides, a second guide database that associates a plurality of operations with a second plurality of guides that are different from the first plurality of guides, and a determining member that determines whether an operation of the user matches the guided operation after the guidance is performed. The guide member provides a guidance found in the first plurality of guides in the first guide database corresponding to the operation performed by the user when the operation performed matches the guided operation. When the operation performed by the user does not match the guided operation, then a guidance found in the second plurality of guides in the second guide database corresponding to the operation performed by the user is provided.

However, conventional sampling keyboards including the conventional technology mentioned above had a problem. Even if a simple instruction is displayed by the keyboard after the switch that starts the sampling feature is pressed, novice users do not know what a sampling feature is to begin with, and thus, it was difficult for such users to intuitively understand what needs to be done after sampling takes place, for example.

As a result, even if conventional sampling keyboards had a sampling feature, the feature was oftentimes not used.

SUMMARY OF THE INVENTION

Accordingly, the present invention is directed to a sampling device that makes how the sampling feature works intuitively understandable even if the sampling feature is started by a novice user.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a sampling device, having: a sound wave receiver configured to receive external sound wave data; and a processor connected to the sound wave receiver, the processor executing: sampling the sound wave data received by the sound wave receiver to convert at least a part of the sound wave data to a digitized tone data; after the sampling, reading out a play data representing either a rhythm pattern including rhythm pattern data or a musical phrase including both a plurality of pitches and associated duration of the pitches; and thereafter, playing back the play data that have been read out using the digitized tone data as a tone for either the rhythm pattern or the musical phrase.

In another aspect, the present disclosure provides a sampling method of a sampling device having a sound wave receiver that receives external sound wave data, the method including: sampling the sound wave data received by the sound wave receiver to convert at least a part of the sound wave data to a digitized tone data; after the sampling, reading out a play data representing either a rhythm pattern including rhythm pattern data or a musical phrase including both a plurality of pitches and associated duration of the pitches; and thereafter, playing back the play data that have been read out using the digitized tone data as a tone for either the rhythm pattern or the musical phrase.

In another aspect, the present disclosure provides a non-transitory storage medium that stores instructions executable by a processor in a sampling device equipped with a sound wave receiver that receives external tone data, the instructions causing the processor to perform the following: sampling the sound wave data received by the sound wave receiver to convert at least a part of the sound wave data to a digitized tone data; after the sampling, reading out a play data representing either a rhythm pattern including rhythm pattern data or a musical phrase including both a plurality of pitches and associated duration of the pitches; and thereafter, playing back the play data that have been read out using the digitized tone data as a tone for either the rhythm pattern or the musical phrase.

It is to be understood that both the foregoing general description and the following detailed description are exemplary and explanatory, and are intended to provide further explanation of the invention as claimed.

BRIEF DESCRIPTION OF THE DRAWINGS

FIG. 11 shows an example of five short sampled data for a voice percussion feature and how each short sampled data is allotted to respective rhythmic instrument tones of drumming instruments.

FIG. 12A shows sampled wave data that was obtained through short sampling as the rhythmic instrument tone of the bass drum.

FIG. 12B shows sampled wave data that was obtained through short sampling as the rhythmic instrument tone of the snare drum.

FIG. 12C shows sampled wave data that was obtained through short sampling as the rhythmic instrument tone of the hi-hat.

DETAILED DESCRIPTION OF EMBODIMENTS

Figure 1:
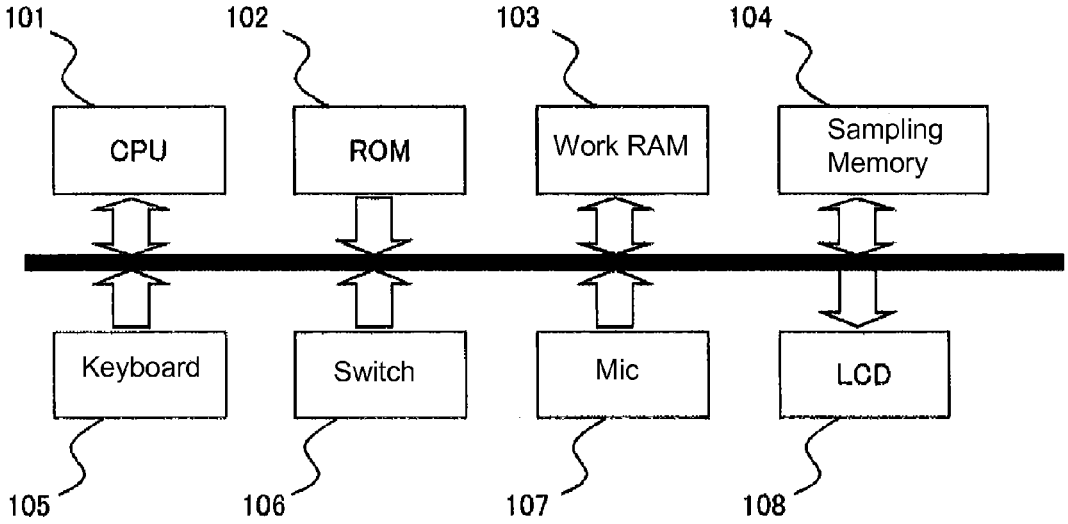
FIG. 1 is a block diagram showing an embodiment of a sampling keyboard.

Embodiments of the present invention are described below in detail with reference to drawings. FIG. 1 is a block diagram showing an embodiment of the sampling keyboard that is a sampling device and an electronic instrument. This sampling keyboard has a CPU (central processing unit) 101 as a processor, a ROM (read only memory) 102, a working RAM (random access memory) 103, a sampling memory 104, a keyboard 105, a switch unit 106, a microphone 107, and an LCD (liquid crystal display) 108. The CPU 101 uses the working RAM 103 as a workspace and controls the overall operation of the sampling keyboard in accordance with a control program and various data (which are to be mentioned later) stored in the ROM 102. The sampling memory 104 is a RAM or a rewritable memory such as a flash memory where the sampled data is stored. The keyboard 105 is used by the user to perform music. The switch unit 106 has a plurality of switches by which the user operates the sampling keyboard. Here, the microphone 107 is a built-in sound receiver for the user to input sound (voice) for sampling. The LCD 108 is a display unit that performs various displays to the user.

Figure 2:
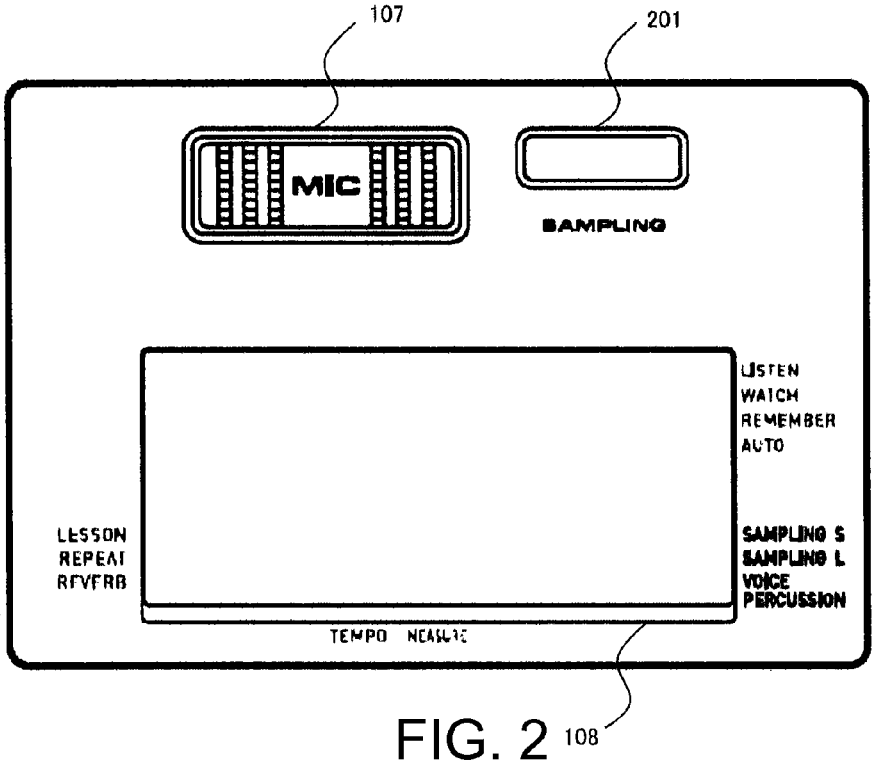
FIG. 2 shows an example of where a microphone, a sampling switch, and an LCD are disposed.

FIG. 2 shows an example of where the built-in microphone 107 (FIG. 1), the sampling switch 201 provided in the switch unit 106, and the LCD 108 (FIG. 1) are located in the present embodiment. A design that makes the microphone 107 more obvious may be adopted to call more attention to the sampling feature. Furthermore, a design in which the microphone 107 and the sampling switch 201 are adjacent to each other may be adopted to indicate that the microphone input and the sampling feature are related to each other.

Figure 3:
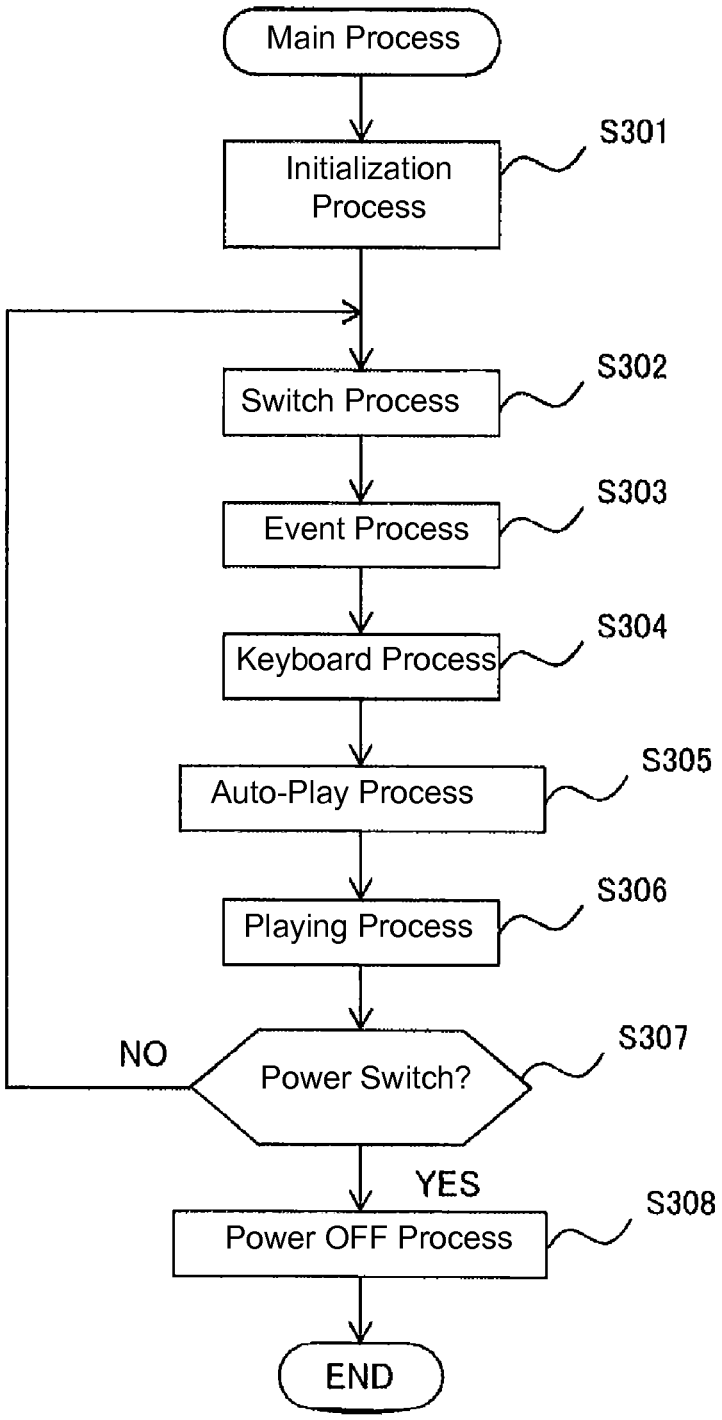
FIG. 3 is a flow chart showing an example of a main process.

FIG. 3 is a flowchart showing the main process of the present embodiment. The process in this flow chart is realized as a process in which the CPU 101 in FIG. 1 executes the main process program stored in the ROM 102. This process is started by the user pressing a power button (not shown) of the switch unit 106 (FIG. 1).

After being started, the CPU 101 executes an initialization process (step S301). In this process, the CPU 101 initializes the respective variables and the like that are stored in the working RAM 103 (FIG. 1).

Next, the CPU 101 executes a switch process (step S302). In this process, the CPU 101 monitors the ON and OFF status of the respective switches of the switch unit 106 in FIG. 1, and generates an appropriate event corresponding to the operated switch.

Figure 4:
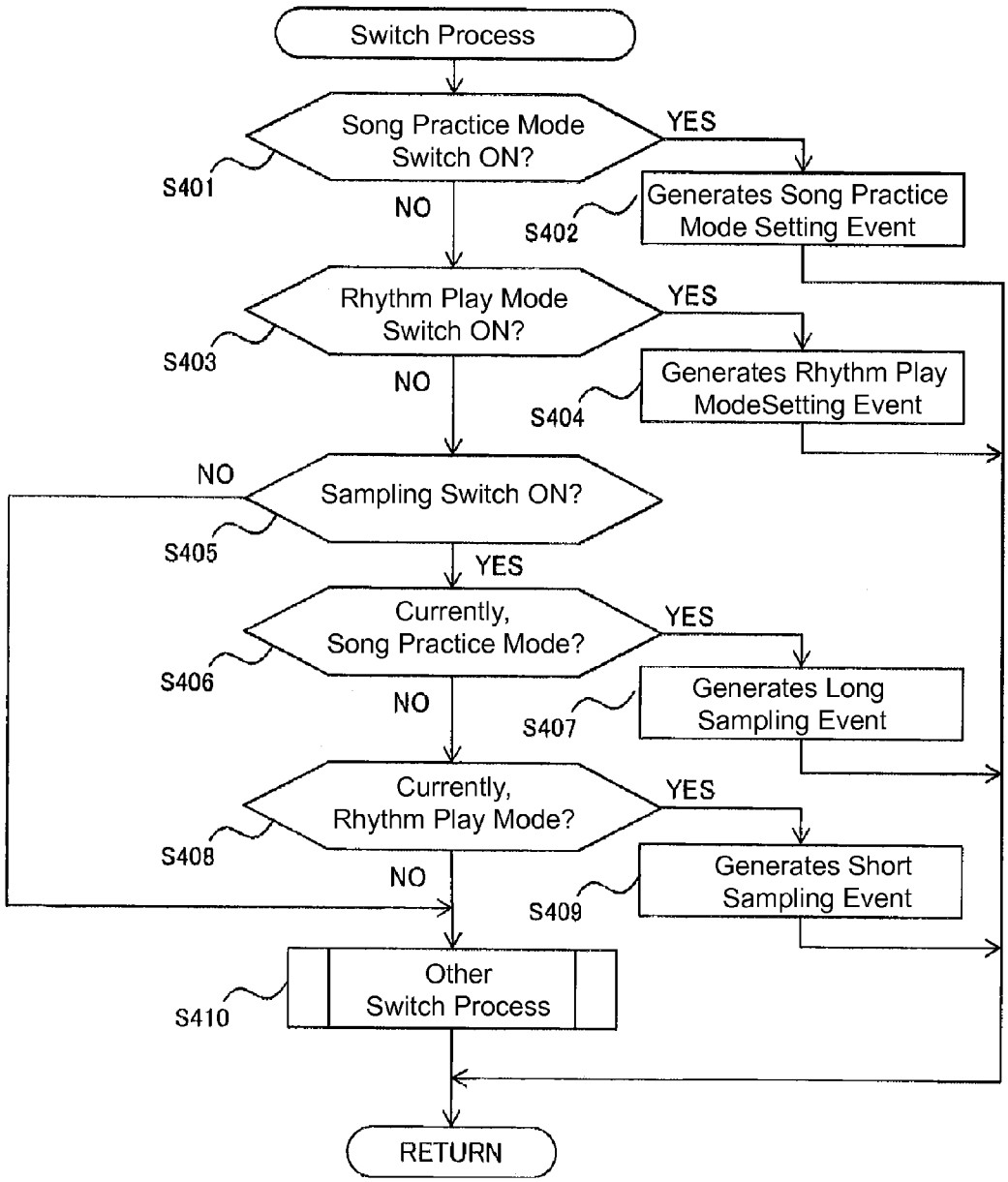
FIG. 4 is a flowchart showing a detailed example of a switch process.

FIG. 4 is a flow chart showing a detailed example of a switch process of the step S302 in FIG. 3.

First, the CPU 101 determines whether or not the user turned ON the song practice mode switch (not shown) of the switch unit 106 (step S401). If the CPU 101 determines YES in the step S401, then the CPU 101 generates a song practice mode setting event (step S402) and ends the flowchart process in FIG. 4. The song practice mode is a mode in which songs can be listened to or practiced (also referred to as song bank mode).

If the CPU 101 determines NO in the step S401, then the CPU 101 determines whether or not the user turned ON the rhythm play mode switch (not shown) of the switch unit 106 (step S403). If the CPU 101 determines YES in the step S403, then the CPU 101 generates a rhythm play mode setting event (step S404) and ends the flowchart process in FIG. 4. The rhythm play mode is a mode in which the sampled plurality of rhythmic instrument tones can be used to play a rhythm (also referred to as voice percussion mode).

If the CPU 101 determines NO in the step S403, then the CPU 101 determines whether or not the user turned ON the sampling switch 201 (see FIG. 2) of the switch unit 106 (step S405).

If the CPU 101 determines YES in the step S405, then the CPU 101 determines whether or not the current mode is the song practice mode (step S406). If the CPU 101 determines YES in the step S406, then the CPU 101 generates a long sampling event (step S407) and ends the flow chart process in FIG. 4.

If the CPU 101 determines NO in the step S406, then the CPU 101 determines whether or not the current mode is the rhythm play mode (step S408). If the CPU 101 determines YES in the step S408, then the CPU 101 generates a short sampling event (step S409) and ends the flow chart process in FIG. 4.

If the CPU 101 determines NO in the step S405 or determines NO in the step S408, then the CPU 101 monitors the ON and OFF status of other switches of the switch unit 106 and executes the process that generates appropriate events corresponding to the operated switches (S410). After the process in the step S410 takes place, the flow chart process in FIG. 4 ends.

As the flow chart process mentioned above in FIG. 4 ends, the switch process in the step S302 in FIG. 3 ends.

Returning to FIG. 3, the CPU 101 executes the event process (step S303) after the switch process in the step S302. Here, the CPU 101 executes various processes corresponding to the respective events that have been generated at the switch process of the step S302.

If the song practice mode setting event has been generated due to the user turning the song practice mode switch ON (step S401 to S402 in FIG. 4), then, in the step S303, the CPU 101 assigns a value indicating the song practice mode to a mode setting variable (not shown) in the working RAM 103 (FIG. 1). If the rhythm play mode setting event has been generated due to the user turning the rhythm play mode ON (step S403 to S404 in FIG. 4), then the CPU 101 assigns a value indicating the rhythm play mode to the mode setting variable (not shown) in the working RAM 103 (FIG. 1). During the steps S406 or S408 in FIG. 4, the CPU 101 determines the current mode by referring to the value of the mode setting variable.

When the user has selected the song practice mode by turning ON the song practice mode switch and then has turned ON the sampling switch 201, thereby generating a long sampling event (steps S406 to S407 in FIG. 4), the CPU 101 executes the long sampling process in the step S303. When the user has selected the rhythm play mode by turning ON the rhythm play mode switch and then has turned ON the sampling switch 201 (FIG. 2), thereby generating a short sampling event (steps S408 to S400 in FIG. 4), the CPU 101 executes the short sampling process in the step S303. Details of the long sampling process and the short sampling process are described later.

After the event process in the step S303, the CPU 101 executes the keyboard process (step 304). Here, the CPU 101 monitors the key depression state of the keyboard 105 (FIG. 1) and generates appropriate data regarding the depressing and releasing of the keys.

Next, the CPU 101 executes an auto-play process (step S305). Here, the CPU 101 executes auto-play of a simple melody phrase using a sampled musical instrument tone immediately after the long sampling process (which is to be mentioned later) is performed and a received sound wave is sampled as the musical instrument tone. Otherwise, the CPU 101 executes an automatic rhythm play process by respectively using rhythmic instrument tones that are sampled sound waves or voice waves obtained by sampling the received sound waves while the short sampling process (which is to be mentioned later) is being performed.

Then, the CPU 101 executes a playing process (step S306). Here, based on the depressing and releasing data formed by the keyboard process in the step S304, the CPU 101 executes a process of playing or muting a sound corresponding to the depressed or released key having a tone such as a prescribed tone wave stored in the ROM 102 or a sampled musical instrument tone.

Then, the CPU 101 determines whether or not the user pressed the power button (not shown) of the switch unit 106 (FIG. 1) in the step S307. If the CPU 101 determines NO in the step S307, then the CPU 101 returns to the process in the step S302. If the CPU 101 determines YES in the step S307, then the CPU 101 executes a prescribed power OFF process such as a data backup process (step S308) and ends the main process in the flow chart of FIG. 3.

Figure 5:
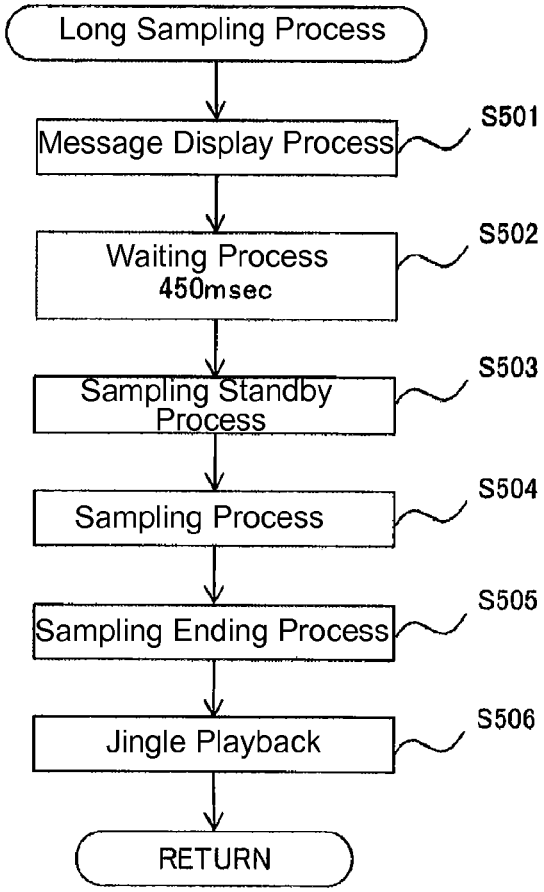
FIG. 5 is a flowchart showing a detailed example of a long sampling process.

FIG. 5 is a flowchart showing a detailed example of the long sampling process executed in the step S303 of FIG. 3. Here, the long sampling event is generated by the user selecting the song practice mode through turning the song practice mode switch ON and then turning the sampling switch 201 (FIG. 2) ON (step S406 to S407 in FIG. 4).

In the present embodiment, the long sampling process can record one sampled data lasting for two seconds.

Figure 6:
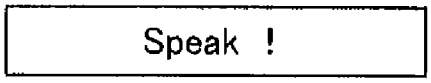
FIG. 6 is an example of a screen displayed on the LCD when sampling starts.

First, the CPU 101 executes a message display process (FIG. 1) that displays a message in the LCD 108 to prompt voice input (step S501). Various types of messages can be displayed such as "Say Something! !" or "Speak Out! !," but in the present embodiment, as shown in FIG. 6, the CPU 101 displays "Speak!" on the LCD 108, for example.

In the present embodiment, sampling is initiated by auto-start. In other words, the CPU 101 monitors the input from the built-in microphone 107 (see FIGS. 1 and 2) and starts the sampling operation if the CPU 101 determines that the amplitude of a sound wave inputted by the user exceeds a prescribed value. The decision for starting the sampling operation takes place during the sampling standby process (step S503).

If the sampling switch 201 is disposed next to the built-in microphone 107 (see FIG. 2), a problem occurs during auto-start. The built-in microphone 107 may capture a noise when the user operates the sampling switch 201 and cause the sampling to start. Even if the sampling switch 201 is not near the built-in microphone 107, as long as the sampling switch 201 and the built-in microphone 107 are disposed in the same exterior case, there is a high possibility that noises will be captured.

Figure 7:
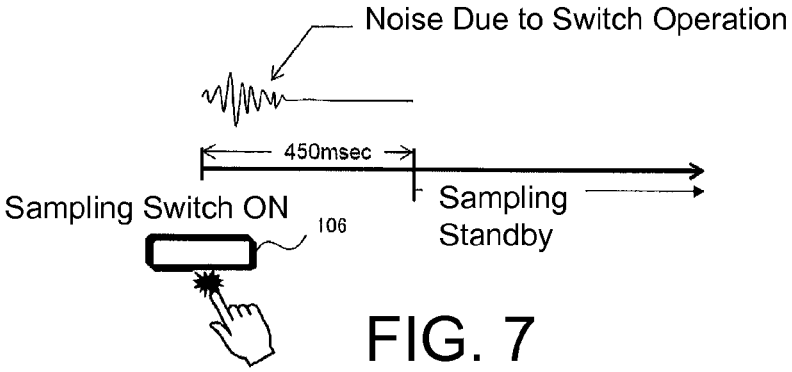
FIG. 7 describes a waiting process.

Thus, in the present embodiment, even if the sampling switch 201 is depressed, the CPU 101 does not immediately transition to the sampling standby state and instead executes the waiting process (step S502). FIG. 7 is a drawing describing the waiting process. The waiting process is a process of waiting for a certain time before entering the sampling standby state. As shown in FIG. 7, approximately 450 msec is appropriate for the waiting time to remove the problem of the noise during the operation of the sampling switch 201 while not making the user feel a delay in the operation.

Figure 8A:
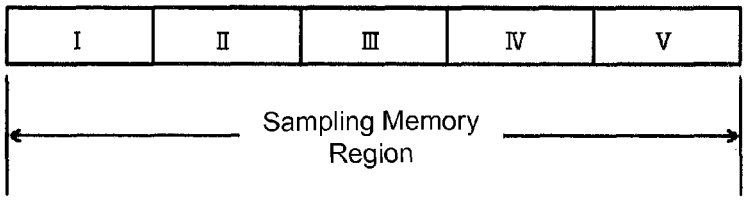
FIG. 8A shows five sampling memory regions in the sampling memory used in the short sampling process.
Figure 8B:
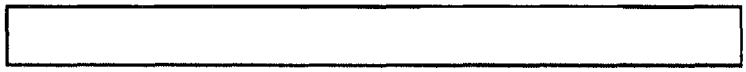
FIG. 8B shows an example of a data configuration of the sampling memory used in the long sampling process.

The CPU 101 executes the sampling standby process (step S503) after the waiting process in the step S502. Here, as mentioned above, the CPU 101 monitors the signal input to the built-in microphone 107 and starts the sampling process when the amplitude of the signal input exceeds a certain value. During the sampling process, the CPU 101 successively records the sound wave data that were A/D converted from the signal inputted through the built-in microphone 107. FIG. 8B shows an example of a data configuration of the sampling memory 104 used in the long sampling process. FIG. 8A will be described later when the short sampling process is explained. As shown in FIG. 8B, the sampled data is stored by using the entire sampling memory region in which two seconds of sound wave data can be stored, for example.

The CPU 101 ends the sampling process of the step S504 once the data volume exceeds the amount that can be stored in the sampling memory 104 (two seconds in the present embodiment, for example), or if the CPU 101 determines that a sound has not been inputted for a certain time (step S505).

After the CPU 101 ends the sampling process of the step S505, the CPU 101 commands jingle playback (step S506). Based on the command, the jingle playback process is executed in the auto-play process of the step S305 in FIG. 3. The jingle playback process is a process that automatically plays a short melody phrase of approximately one to two seconds using a musical instrument tone that is the sampled data obtained through the long sampling process of the step S303. The playback of the received sound wave that was just sampled as a musical instrument tone functions as a notification to the user that the sampling ended, and the playback can also act as an introduction of the sampling feature to users that are new to the feature.

Figure 9:
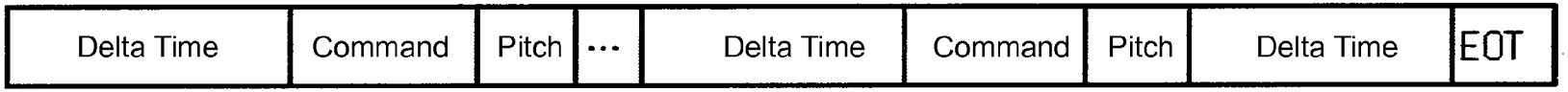
FIG. 9 shows an example of a data configuration of a melody play data.

FIG. 9 shows an example of a data configuration of a melody play data that is used during the jingle playback process in the step S305 in FIG. 3. This melody play data is stored in the ROM 102 (FIG. 1), for example. The data format of the melody play data may be a simplified version of a standard MIDI (musical instrument digital interface) format, for example. The melody play data in the present embodiment is a plurality of data units aligned in which each data unit has a delta time, a command, and a pitch. Here, the delta time indicates the time elapsed between the current event and the preceding event. This time elapsed is indicated as a number of ticks in which each tick is four milliseconds, for example. If the value of the delta time is ten, then 10×4 msec=40 msec becomes the time elapsed from the preceding event. The two types of commands are note ON and note OFF. After the command, data indicating the pitch of the sound that is being note ON or note OFF follows. In addition, at the end of the melody data, an EOT (end of track) data that indicates the end of the data is disposed. In the present embodiment, the delta time is two bytes, and the command, pitch, and EOT data are all one byte of data. If a unit data in which the delta time is zero (if the delta time is the time elapsed from the start, the data is the same data as the data having the previous delta time) is written, then a plurality of chords represented by the respective unit data can be played simultaneously.

In the present embodiment, ten groups of melody play data having the data configuration mentioned above are stored in the ROM 102, for example. The CPU 101 executes the jingle playback process by randomly selecting one group of melody play data out of the ten groups and using the sampled musical instrument tone obtained by the long sampling process during the event process of the step S303 in FIG. 3 as the musical instrument tone. The CPU 101 reads the melody play data (see FIG. 9) serially one unit data at a time from the beginning when the jingle playback starts, and as the time indicated by the delta time of the unit data that is read passes, a sound is muted or played at the pitch commanded by the unit data (note ON or note OFF) using the sampled wave data stored in the sampling memory 104 (FIG. 1) as the musical instrument tone. The CPU 101 determines the time elapsed based on the time kept by an internal timer (not shown). After one playing process ends, the CPU 101 reads the next unit data of the melody play data and repeatedly executes the same operation that has been mentioned above each time the step S305 of FIG. 3 is performed.

In this manner, according to the present embodiment, if the user selects the song practice mode and turns the sampling switch 201 (FIG. 2) ON to obtain a sound wave data for two seconds, a jingle playback of a short melody phrase is performed using the sampled musical instrument tone right after the user uses the sampling feature, and thus, the user can immediately confirm the effects of using sampling.

Figure 10:
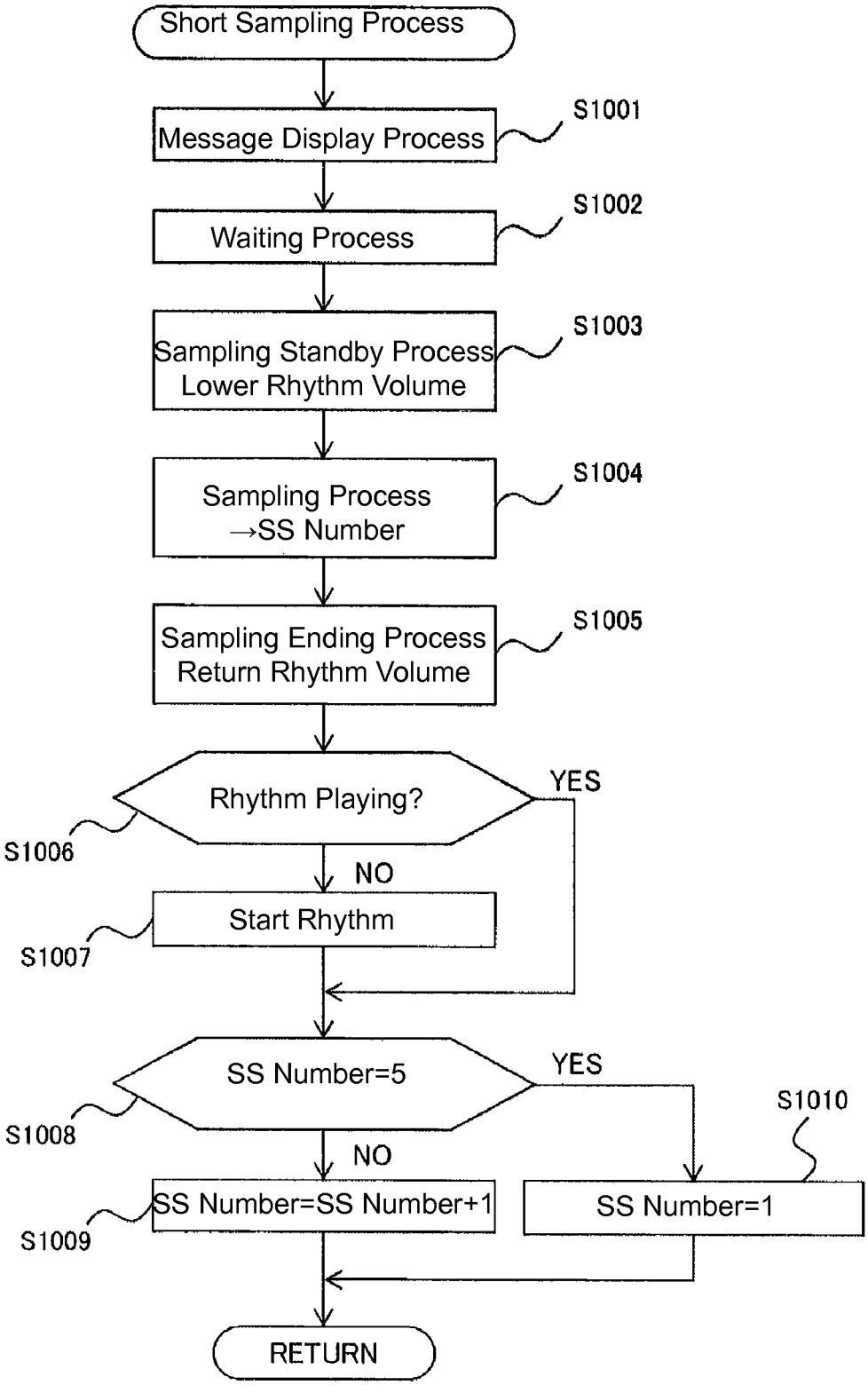
FIG. 10 is a flowchart showing a detailed example of a short sampling process.

FIG. 10 is a flow chart showing a detailed example of the short sampling process that takes place in step S303 of FIG. 3. Here, after the rhythm play mode switch is turned ON and the mode is set to the rhythm play mode, the sampling switch 201 (FIG. 2) is turned ON to generate the short sampling event (steps S408 to S409 in FIG. 4).

During the aforementioned long sampling process, two seconds of sampled data can be stored as the melody data, for example. However, as shown in FIG. 8A, in the short sampling process described below, the sampling memory region of two seconds is divided into five regions (I, II, III, IV, and V), and the five regions can respectively store five sampled data each lasting 0.4 seconds, for example. In the short sampling process, a voice percussion feature is realized such that each of the five sampled wave data can be allotted to the rhythmic instrument tones of the respective instruments (bass drum, snare drum, etc.) that play a rhythm pattern using the respective rhythmic instrument tones that were sampled.

FIG. 11 shows an example of respectively allotting five short sampled data to the drumming instruments for the voice percussion feature. In the present embodiment, the respective short sampled data are identified by an SS number that is a variable in the working RAM 103 (FIG. 1). As shown in FIG. 11, the short sampled wave data for SS number=1 is the rhythmic instrument tone of a bass drum, the short sampled wave data for SS number=2 is the rhythmic instrument tone of a snare drum, the short sampled wave data for SS number=3 is the rhythmic instrument tone of a hi-hat, the short sampled wave data for SS number=4 is the rhythmic instrument tone of a cymbal, and the short sampled wave data for SS number=5 is the rhythmic instrument tone of a tam. The user can play the short sampled wave data respectively allotted to the drumming instruments as the rhythmic instrument tone by pressing a key corresponding to each drumming instrument.

Below, the flow chart of the short sampling process shown in FIG. 10 is described.

The message display process in step S1001 and the waiting process in step S1002 are similar to the processes in the step S501 and the step S502 in FIG. 5 for the long sampling process.

In the short sampling process of the present embodiment, the automatic rhythm play is performed using the sampled rhythmic instrument tone even in the middle of sampling the five short sampled wave data. As a result, the user can perform sampling for the rest of the five rhythmic instrument tones that matches the rhythms played by the rhythmic instrument tones that have already been sampled. Here, the CPU 101 lowers the rhythm volume to avoid the sampling to automatically start due to the rhythm being played during a sampling waiting process similar to the step S503 in FIG. 5.

Next, in a sampling process similar to the step S504 in FIG. 5, the CPU 101 switches the sampling memory region (see FIG. 8A) in which the sampled data will be stored according to the SS number indicated as a variable in the working RAM 103 (step S1004). First, in the initialization process of the step S301 of FIG. 3, the value of the variable indicating the SS number in the working RAM 103 is initialized such that the SS number=1. Here, if the current SS number equals to 1, then the region I of FIG. 8A is selected. When the SS number is changed to 2, 3, 4, and 5, the regions II, III IV, and V of FIG. 8A are respectively selected.

Next, during a sampling ending process similar to step S505 of FIG. 5, the CPU 101 restores the rhythm volume that was reduced in the step S1003.

Then, the CPU 101 commands the start of the rhythm if the rhythm is not being played (steps S1007).

After this, the value of the SS number in the working RAM 103 is increased by one if the value is not five (step S1008 to S1009). If the value of the SS number reaches five, then the value returns to one (step S1008 to S1010). After the process in the step S1009 or the step S1010 takes place, the CPU 101 ends the short sampling process in FIG. 10 and ends the event process of the step S303 in FIG. 3.

As a result, the user can perform short sampling by cyclically changing the sampling region among the five sampling regions.

While the above-mentioned short sampling process shown in the flow chart of FIG. 10 is being executed during the event process of the step S303 in FIG. 3, the CPU 101 executes the automatic rhythm play using the voice percussion feature in the auto-play process of the step S305 in FIG. 3.

FIGS. 12A to 12C illustrate the automatic rhythm play processes of the voice percussion feature. First, in the initial state, the five sampling memory regions (see FIG. 8A) in the sampling memory 104 are all empty. Then, if the short sampling process takes place, the sampling for the SS number=1 starts, and rhythm play is started. At this time, the sampled data is stored only in the region I of the sampling memory that corresponds to the SS number=1. If the sampled wave data for SS number=1 is a rhythmic instrument tone for a bass drum (see FIG. 11), the sampled sound is played at the timing in which the sound of the bass drum is emitted in the rhythm played, for example. As shown in FIG. 12A, "boom" is the sampled wave data that was obtained through short sampling as the rhythmic instrument tone of the bass drum.

When the next short sampling is executed, the SS number increases to two, and thus the sampling for SS number=2 starts. At this time, the sampled wave data are stored in the region II of the sampling memory 104 that corresponds to the SS number=2 filling in the regions I and II, respectively corresponding to the SS numbers=1 and 2, with the sampled data. Therefore, during the rhythm play, the sound of the sampled wave data of the SS number=1 is emitted as the rhythmic instrument tone of the bass drum at the timing in which the bass drum is played, and, additionally, the sound of the sampled wave data of the SS number=2 is emitted as the rhythmic instrument tone of the snare drum at the timing in which the snare drum is played (see FIG. 11), for example. In FIG. 12B, "tak" is the sampled wave data that was obtained through short sampling as the rhythmic instrument tone of the snare drum.

When the next short sampling is executed, the SS number is increased to three, and thus, the sampling for SS number=3 starts. At this time, the sampled wave data are stored in the region III of the sampling memory 104 that corresponds to the SS number=3, filling in the regions I to III, respectively corresponding to the SS numbers=1 to 3, with the sampled data. Thus, during the rhythm play, the sound of the sampled wave data of the SS number=1 is emitted as the rhythmic instrument tone of the bass drum at the timing in which the bass drum is played, the sound of the sampled wave data of the SS number=2 is emitted as the rhythmic instrument tone of the snare drum at the timing in which the snare drum is played, and the sound of the sampled wave data of the SS number=3 is emitted as the rhythmic instrument tone of the hi-hat at the timing in which the hi-hat is played (see FIG. 11), for example. In FIG. 12C, "tik" is the sampled wave data obtained through short sampling as the rhythmic instrument tone of the hi-hat.

In this manner, the number of instruments that are being played in the rhythm pattern can be increased by repeating the short sampling process. When the sampling for SS number=5 takes place, the SS number returns to SS number=1, and thereafter the tones of the rhythm that has been played will be successively replaced with the newly sampled data.

As explained above, after the device samples a received sound wave data, the device plays back a simple melody phrase using a musical instrument tone that was just sampled or plays back a rhythm using the rhythmic instrument tone that was just sampled so that the user can immediately grasp what the sampling feature is and how it can be used.

Furthermore, when the sampling switch is depressed by a user, the LCD 108 (FIG. 1) displays a message that encourages the user to voice a sound, and thus, even users who do not know about the feature can start the sampling feature by making a sound.

Because of these effects, children and users that are not familiar with instruments can understand the sampling feature, and in storefronts in particular, the exhibited product having the sampling feature can appeal to those who know nothing about instruments and showcase how enjoyable the sampling feature is.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A sampling device, comprising:

a sound wave receiver configured to receive external sound wave data;

a processor connected to the sound wave receiver, the processor being configured to receive a sampling command from a user; and a memory connected to the processor, the memory storing a preset play data representing either a rhythm pattern including rhythm pattern data or a musical phrase including both a plurality of pitches and associated duration of the pitches, wherein in response to the sampling command from the user, the processor executes:

sampling the sound wave data received by the sound wave receiver to convert at least a part of the sound wave data to a digitized tone data;

after the sampling, automatically without user interventions, reading out the preset play data from the memory; and thereafter, automatically without user interventions, playing back the preset play data that have been read out from the memory to the user using the digitized tone data as a tone for either the rhythm pattern or the musical phrase.

2. The sampling device according to claim 1, further comprising another memory connected to the processor, wherein the processor stores in said another memory the digitized tone data, and wherein the playing back includes reading out the digitized tone data from said another memory and using the digitized tone data as the tone for the rhythm pattern or the musical phrase represented by the preset play data.

3. The sampling device according to claim 2, wherein the processor starts reading out the preset play data representing the musical phrase automatically without user interventions immediately after the sampling.

4. The sampling device according to claim 2, wherein the sound wave receiver is configured to receive a plurality of sound wave data successively as a plurality of rhythmic instrument tones, and the processor causes the preset play data representing the rhythm pattern to be played, wherein the processor samples the plurality of sound wave data successively as the sound wave receiver receives said sound wave data so as to successively convert the plurality of sound wave data to respective digitized tone data and store the digitized tone data in said another memory as respective rhythmic instrument tones, and wherein the processor causes said rhythm pattern to continue playing with the rhythmic instrument tones that have been successively stored in said another memory while sampling new sound wave data in the plurality of sound wave data.

5. The sampling device according to claim 2, wherein the processor is configured to receive a command from the user setting forth a mode of the sampling device to one of a song practice mode and a rhythm play mode, the processor further being configured to receive a sampling command from the user, wherein, when the mode is set to the song practice mode and when the sampling command is received from the user, the processor executes:

sampling the sound wave data received by the sound wave receiver to convert said at least a part of the sound wave data to the digitized tone data to be used for the musical phrase;

after the sampling, reading out the preset play data representing the musical phrase including the plurality of pitches and the associated duration thereof; and thereafter, playing back the preset play data that have been read out using the digitized tone data as the tone for the musical phrase, and wherein, when the mode is set to the rhythm play mode and when the sampling command is received from the user, the sound wave receiver receives a plurality of sound wave data successively as a plurality of rhythmic instrument tones, and the processor executes:

sampling the plurality of sound wave data successively as the sound wave receiver receives said sound wave data so as to successively convert the plurality of sound wave data to respective digitized tone data and store the digitized tone data in said another memory as respective rhythmic instrument tones, and playing back the preset play data representing said rhythm pattern with the rhythmic instrument tones that have been successively stored in said another memory, the processor causing the rhythm pattern to continue playing while sampling new sound wave data in the plurality of sound wave data.

6. The sampling device according to claim 1, wherein the processor starts sampling the sound wave data received after a prescribed time has passed since said sampling command to start sampling is provided by the user.

7. The sampling device according to claim 1, further comprising:

a display unit that displays a message to the user encouraging the user to utter a sound when the processor starts sampling.

8. The sampling device according to claim 1, further comprising:

a keyboard connected to the processor, the keyboard having a plurality of keys respectively specifying pitches, wherein in response to operations of the keys of the keyboard, the processor causes the sampling device to emit a sound having a tone corresponding to said digitized tone data with the at least one pitch specified by the operations of the keys.

9. A sampling method to be executed by a sampling device having a sound wave receiver that receives external sound wave data and a memory that stores a preset play data representing either a rhythm pattern including rhythm pattern data or a musical phrase including both a plurality of pitches and associated duration of the pitches, the method comprising:

receiving a sampling command from a user;

in response to the received sampling command, sampling the sound wave data received by the sound wave receiver to convert at least a part of the sound wave data to a digitized tone data;

after the sampling, automatically without user interventions, reading out the preset play data from the memory; and thereafter, automatically without user interventions, playing back the preset play data that have been read out from the memory to the user using the digitized tone data as a tone for either the rhythm pattern or the musical phrase.

10. A non-transitory storage medium that stores instructions executable by a processor in a sampling device equipped with a sound wave receiver that receives external tone data and a memory that stores a preset play data representing either a rhythm pattern including rhythm pattern data or a musical phrase including both a plurality of pitches and associated duration of the pitches, the instructions causing the processor to perform the following:

receiving a sampling command from a user;

in response to the received sampling command, sampling the sound wave data received by the sound wave receiver to convert at least a part of the sound wave data to a digitized tone data;

after the sampling, automatically without user interventions, reading out the preset play data from the memory; and thereafter, automatically without user interventions, playing back the preset play data that have been read out from the memory using the digitized tone data as a tone for either the rhythm pattern or the musical phrase.

11. A sampling device, comprising:

a sound wave receiver configured to receive external sound wave data; and a processor connected to the sound wave receiver, the processor executing:

sampling the sound wave data received by the sound wave receiver to convert at least a part of the sound wave data to a digitized tone data;

after the sampling, reading out a play data representing either a rhythm pattern including rhythm pattern data or a musical phrase including both a plurality of pitches and associated duration of the pitches; and thereafter, playing back the play data that have been read out using the digitized tone data as a tone for either the rhythm pattern or the musical phrase, wherein the sampling devices further comprises a memory connected to the processor, wherein the processor stores in said memory the digitized tone data, wherein the playing back includes reading out the digitized tone data from said memory and using the digitized tone data as the tone for the rhythm pattern or the musical phrase represented by the play data, wherein the processor is configured to receive a command from a user setting forth a mode of the sampling device to one of a song practice mode and a rhythm play mode, the processor further being configured to receive a sampling command from the user, wherein, when the mode is set to the song practice mode and when the sampling command is received from the user, the processor executes:

sampling the sound wave data received by the sound wave receiver to convert said at least a part of the sound wave data to the digitized tone data to be used for the musical phrase;

after the sampling, reading out the play data representing the musical phrase including the plurality of pitches and the associated duration thereof; and thereafter, playing back the play data that have been read out using the digitized tone data as the tone for the musical phrase, and wherein, when the mode is set to the rhythm play mode and when the sampling command is received from the user, the sound wave receiver receives a plurality of sound wave data successively as a plurality of rhythmic instrument tones, and the processor executes:

sampling the plurality of sound wave data successively as the sound wave receiver receives said sound wave data so as to successively convert the plurality of sound wave data to respective digitized tone data and store the digitized tone data in the memory as respective rhythmic instrument tones, and playing back the play data representing said rhythm pattern with the rhythmic instrument tones that have been successively stored in the memory, the processor causing the rhythm pattern to continue playing while sampling new sound wave data in the plurality of sound wave data.

* * * * *